US006933804B2

(12) United States Patent
Rathgeber et al.

(10) Patent No.: US 6,933,804 B2
(45) Date of Patent: Aug. 23, 2005

(54) RADIO FREQUENCY DIPLEXER

(75) Inventors: Roland Rathgeber, Rosenhelm (DE); Wilhelm Weitzenberger, Simbach/Inn (DE); Dietmar Sieraczewski, Flintsbach/Inn (DE)

(73) Assignee: Kathrein-Werke KG, Rosenheim (DE)

( * ) Notice: Subject to any disclaimer, the term of this patent is extended or adjusted under 35 U.S.C. 154(b) by 15 days.

(21) Appl. No.: 10/663,987

(22) Filed: Sep. 17, 2003

(65) Prior Publication Data

US 2004/0222868 A1 Nov. 11, 2004

(30) Foreign Application Priority Data

May 8, 2003 (DE) ..... 103 20 620

(51) Int. Cl.[7] ..... H01P 5/12
(52) U.S. Cl. ..... 333/134; 333/203; 333/206
(58) Field of Search ..... 333/126, 129, 333/134, 132, 135, 202, 204, 206, 208, 212, 203

(56) References Cited

U.S. PATENT DOCUMENTS 4,890,078 A * 12/1989 Radcliffe ..... 333/134
5,083,102 A * 1/1992 Zaki ..... 333/212
5,329,687 A * 7/1994 Scott et al. ..... 29/527.2
5,410,284 A * 4/1995 Jachowski ..... 333/202
5,748,058 A * 5/1998 Scott ..... 333/202
5,994,978 A * 11/1999 Vangala ..... 333/134
6,052,040 A * 4/2000 Hino ..... 333/134
6,392,506 B2 5/2002 Wulff
6,624,723 B2 * 9/2003 Wang ..... 333/134
2002/0180559 A1 * 12/2002 Jang ..... 333/134

FOREIGN PATENT DOCUMENTS

EP 0 986 125 A1 3/2000
EP 1 169 747 B1 6/2002

* cited by examiner

*Primary Examiner*—Seungsook Ham
(74) *Attorney, Agent, or Firm*—Nixon & Vanderhye P.C.

(57) ABSTRACT

An improved radio frequency diplexer has resonators which are associated either with the transmission path or with the reception path, and at least two additional resonators are also provided. The at least two additionally provided resonators form an interconnection resonator pair which are strongly coupled to one another. Both the transmission path and the reception path are coupled to the second additional resonator, or both the transmission path and the reception path are coupled to the first additional resonator which is provided for inputting to/outputting from the common signal path.

11 Claims, 4 Drawing Sheets

RADIO FREQUENCY DIPLEXER

FIELD

The technology herein relates to a radio frequency diplexer in the form of interconnected radio frequency filters.

BACKGROUND AND SUMMARY

In radio systems, for example in the mobile radio field, it is often desirable to use a common antenna to transmit and receive signals. The transmission signals and received signals may lie in different frequency bands. The antenna which is used must be suitable for transmitting and receiving both frequency bands. Suitable frequency filtering separates the transmission signals and received signals, ensuring on the one hand that the transmission signals are passed on from the transmitter only to the antenna (not in the direction of the receiver), and on the other hand that the received signals are passed on from the antenna only to the receiver.

A pair of radio frequency filters may be used for this purpose, both of which pass a specific frequency band, namely the respectively desired frequency band (band pass filters). However, it is also possible to use a pair of radio frequency filters which block a specific frequency band, namely the respectively undesired frequency band. These are referred to as bandstop filters. It is also possible to use a pair of radio frequency filters: a first filter passes frequencies below a frequency that is between the transmission band and the reception band, and blocks the bands above this (low-pass filter); and a second filter blocks frequencies below this frequency that is between the transmission band and the reception band, and passes frequencies above this. This is what is referred to as a high-pass filter. Further combinations of the stated filter types may be used.

U.S. Pat. No. 6,392,506 B2 discloses a duplex filter in which radio frequency filters are interconnected and in which the inner conductor of a common coaxial transmission/reception connecting socket is connected via two conductor loops to in each case one closest resonator chamber in the transmission and receiving filters. In this case, a vertically projecting inner conductor is provided internally in each resonator chamber, with the chamber wall which bounds the resonator chamber radially on the outside being used as an outer conductor. In the corresponding already known solution, the area which is enclosed by the wire loop including the current feedback path via the inner wall of the resonator cavity to the outer conductor of the connecting socket (inductance) determines the strength of the signal injection in the respective filter path. The input can be tuned by mechanical deformation or bending of the wire loop.

In the capacitive case, the inner conductor of the common transmission/receiving connecting socket is split into two conductor pieces, which each end in flat metal pieces. The strength of the signal input is governed by the size and shape of these metal surfaces, and by their distance from the inner conductor of the respective resonator (the capacitance resulting from this). The input can likewise be tuned by mechanical deformation or bending of these metal surfaces, and by changing the distance to the respective inner conductor of the resonator filter.

Both variants have the disadvantage that the tuning process can be carried out only by purely reproducible mechanical manipulations (bending or deformation), and that the tuning of the input to one filter path also influences the electrical behavior of the respective other filter path, and vice versa, so that the two input devices must generally be varied alternately two or more times during the tuning process.

This disadvantage is avoided according to FIGS. 3 and 4 in the prior publication U.S. Pat. No. 6,392,506 B2 which has been mentioned, in that there is now only one capacitive input from the inner conductor of a common connecting socket to one resonator which is additionally provided for the two filter paths and may be referred to as a so-called "central resonator". This provides coupling in the conventional manner via openings in the separating walls to in each case one resonator in the transmission filter path and one resonator in the receiving filter path.

However, in this case as well, the central resonator which is acquired in addition to the resonators in the filter path requires additional space and also results in additional costs, even though it does not significantly contribute to the frequency selectivity of the filter paths.

The exemplary illustrative non-limiting implementations herein provide for the interconnection of radio frequency filters, in order to produce a frequency diplexer, in a better way than the generic prior art.

In a first variant according to the exemplary illustrative non-limiting implementation, the two radio frequency filter paths are interconnected by means of an inductive or capacitive input to one resonator in a pair of resonators which are strongly coupled to one another (interconnection resonator pair). This avoids the disadvantages explained in the prior art. This means that, in contrast to the prior art, there is no longer any need to carry out a tuning process at the two points between which there is an interaction.

Furthermore, the resonator pair which are strongly coupled to one another contribute to selection of the two filter paths, to be precise in a similar manner to that if one of the two resonators were in each case permanently associated with one of the filter paths. This avoids the central resonator which is required in the prior art, causes additional costs, and furthermore, also requires even more space.

The coupling between the interconnection resonator pair and the filter paths in the frequency diplexers can in this case be carried out differently, namely, according to the exemplary illustrative non-limiting implementation, it is possible for the two filter paths, namely the filter path for the transmission signals and the filter path for the received signals, to be coupled to the second resonator in the resonator pair which are strongly coupled to one another, which is not used for the input; or both filter paths can be connected to the first resonator in the strongly coupled resonator pair, which is also used for the input from the inner conductor of a coaxial radio connection.

Advantageous, space-saving geometric arrangements of the resonator chambers are possible for certain numbers of resonators, but perhaps not for other forms of interconnection. For the purposes of the exemplary illustrative non-limiting implementations, it is thus possible, for example, to provide a frequency diplexer with a total of six resonators, which are arranged in two rows of three each, and in which all three connecting sockets, for the transmitter, for the receiver and for a common port or a common connecting socket (a common transmitting/receiving connecting socket, for example) for connection of an antenna or for the input/output of a common signal path, are located on the same side of the housing. The exemplary illustrative non-limiting implementation makes it possible to provide symmetrical, compact overall geometries.

Furthermore, one preferred illustrative non-limiting implementation allows particularly strong coupling by considerably shortening the distance between the inner conductors of the relevant resonators.

The radio frequency diplexer according to the exemplary illustrative non-limiting implementation is preferably constructed such that at least one resonator, preferably two or more resonators, and preferably all of the resonators, has or have a coaxial configuration. The radio frequency diplexer can likewise be constructed with one or more or all of the resonators using dielectric resonators, for example ceramic resonators. Finally, however, it is likewise possible to construct the radio frequency diplexer such that at least one resonator, but preferably two or more resonators or even all of the resonators, users or use stripline technology. In other words, all methods imaginable may be used, in which it is possible to approximately implement the explained principles.

BRIEF DESCRIPTION OF THE DRAWINGS

These and other features and advantages will be better and more completely understood by referring to the following detailed description of exemplary non-limiting illustrative implementations in conjunction with the drawings of which.

DETAILED DESCRIPTION

Figure 1:
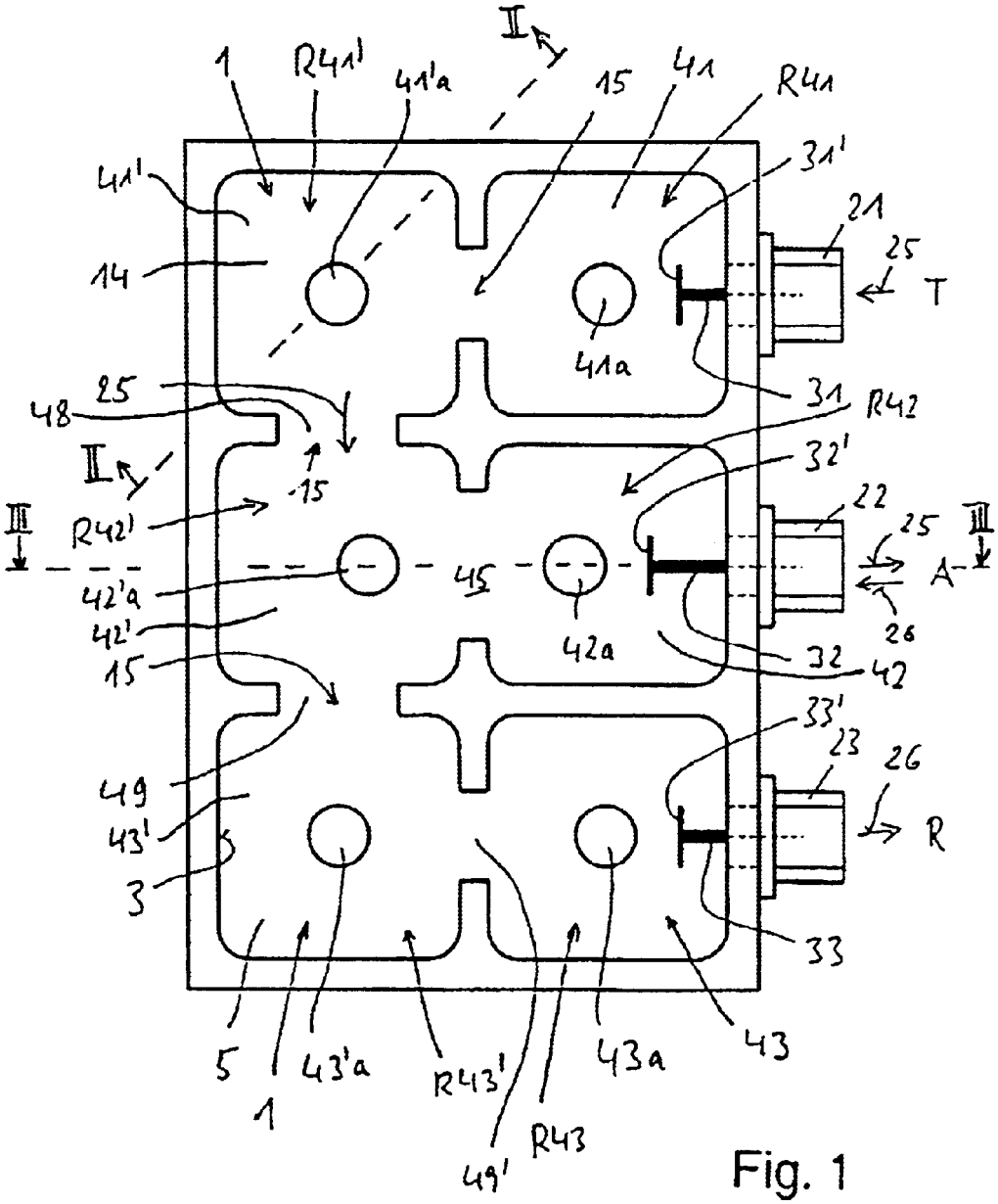
FIG. 1 shows a schematic horizontal cross section illustration through one preferred illustrative non-limiting implementation of a diplexer with radio frequency filters interconnected.

FIG. 1 shows a schematic horizontal cross section through one preferred non-limiting implementation according to the exemplary illustrative non-limiting diplexer with interconnected radio frequency bandpass filters.

For this purpose, the exemplary illustrative non-limiting implementation shown in FIG. 1 has six individual circuit radio frequency filters 1, with a coaxial configuration, that is to say six resonators. The configuration of the resonators 1 under discussion is in principle known from EP 1 169 747 B1, to whose complete scope and full content the present application refers. It is also possible to see from this that a single circuit RF filter or single resonator 1 with coaxial configuration in principle comprises an electrically conductive outer conductor 3, an inner conductor 4 which is arranged concentrically or coaxially with respect to it, and a base 5, via which the electrically conductive outer conductor 3 and the electrically inner conductor 4 are electrically connected to one another.

The single resonator can be closed at the top via a cover 7 that can be fitted (see also FIG. 2), that is to say via an electrically conductive cover 7, with the inner conductor ending at a distance underneath the cover 7. A specific setting to one resonator frequency can be provided by specific adjustment mechanisms, for example by axial adjustment of the inner conductor or by axial adjustment of a tuning element which is provided in the cover, as shown in FIG. 2.

Figure 2:
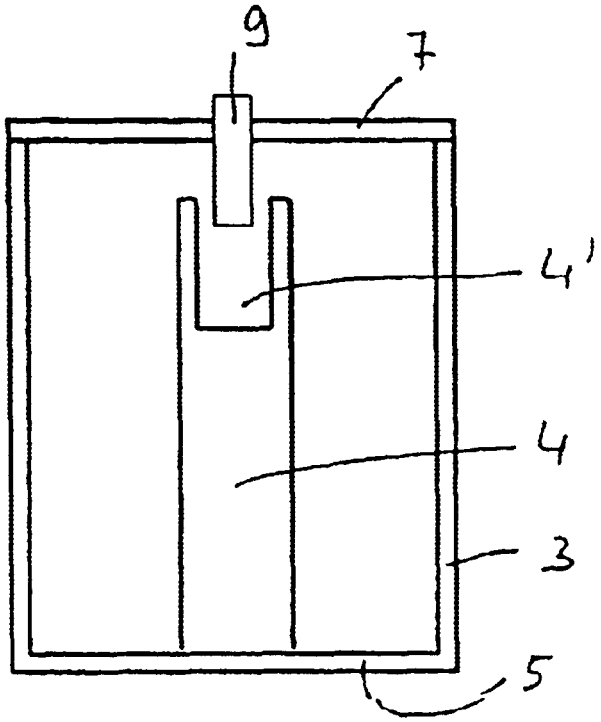
FIG. 2 shows a cross section illustration along the lines II—II in FIG. 1.
Figure 3:
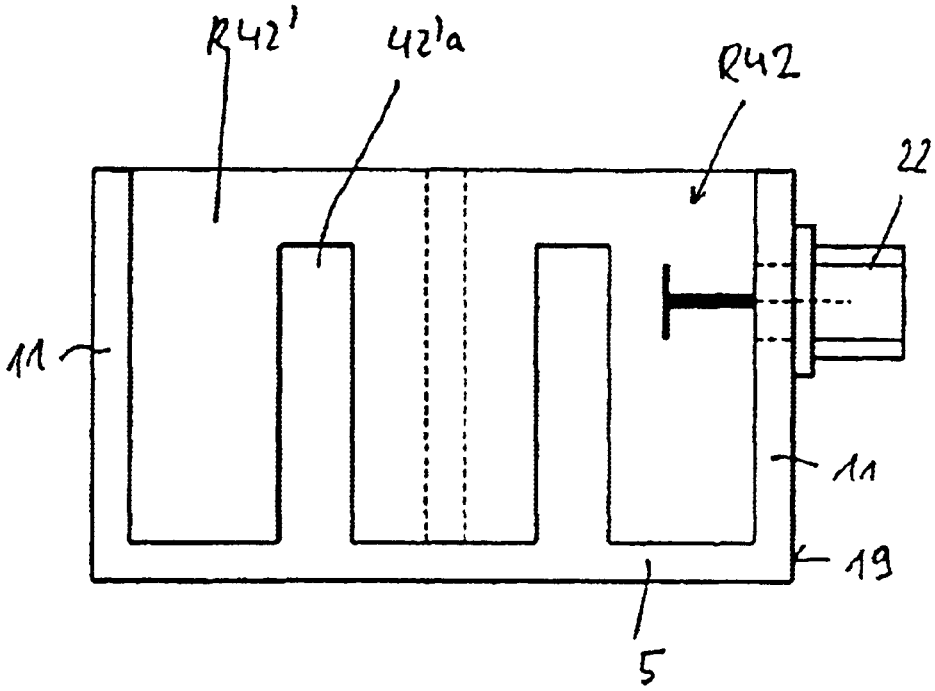
FIG. 3 shows a cross section illustration along the III—III in FIG. 1.

In the illustrated exemplary illustrative non-limiting implementation shown in FIGS. 1 and 2, one of the six coaxial radio frequency resonators that are shown in FIG. 1 is shown with a rather square base surface or base 5, whose cavity is bounded by metallic walls. The corners are rather rounded, which has manufacturing advantages (particularly if the resonator cavity is milled from a solid metal block). The metallic inner conductor, which is generally in the form of a circular cylinder and whose length is somewhat less than one quarter of the wavelength of the resonant frequency, normally ends at a distance of generally a few millimeters under the cover. A tuning element 9 is provided in the exemplary illustrative non-limiting implementation shown in FIG. 2, and is in the form of a cylindrical metal pin which is screwed in and out to different extents from the cover and in the process can engage to a different extent in a recess 4' which is incorporated at the upper end of the inner conductor 4. This makes it possible to vary the resonant frequency.

Two or more of these single resonators 1 are then accommodated in a common housing 11, with the side walls of the cavities 14 which normally separate the single resonators from one another being provided in some cases with apertures 15, which produce the electromagnetic signal path.

Furthermore, three connecting sockets are provided in the illustrated exemplary illustrative non-limiting implementation, at the same distance from one another on one side 19 of the housing 11, that is to say in the illustrated exemplary illustrative non-limiting implementation 3 coaxial connecting sockets 21, 22 and 23. The respectively associated inner conductors 31, 32 and 33 for the three connecting sockets 21 to 23 are each lengthened by a few millimeters into the respective resonator chambers 41, 42 and 43 which are adjacent to the housing sidewall 19, and each end in a conductive flat element, in the illustrated exemplary non-limiting implementation in the form of an electrically conductive disk 31', 32', or 33' respectively.

FIG. 1 also shows that, for example, a transmitter T is connected to the connecting socket 21, a common signal path A which is used for the input and output is connected to the central connection 22, and a receiver R is connected to the third connection 23. In other words, transmission signals are fed in from the transmitter via the signal path as shown by the illustrated arrows 25 via the duplex filter formed in this way and having the radio frequency bandpass filters into the common signal path A, for example to an antenna, whereas, in contrast, signals which are received via the common signal path A are fed into the receiver R from the central connecting socket, as shown by the arrows 26.

The capacitance which is formed between the central disk element or other flat metal piece 32' and the adjacent resonator inner and conductor 42*a* of the input resonator R42 provides the input for the electrical field from the common signal path A or from the common connecting socket 22 to the resonator chamber 42, and vice versa.

In the illustrated exemplary illustrative non-limiting implementation, strong coupling is provided via the connecting opening 45 between this first resonator chamber 42, which produces a connection to the antenna A, and an adjacent, second resonator chamber 42', which is connected to it.

In addition, the coupling which is required for this type of interconnection between the two resonator chambers 42 and 42' can be adjusted as follows. It is obvious from the exemplary non-limiting implementation s which have been explained that, with respect to the signal path, the distance between two adjacent inner conductors 42'*a* and 43'*a* as well as 43'*a* and 43*a* as well as the distance between the inner conductors 42'*a* and 41'*a* as well as 41'*a* and 41*a* is in each case approximately the same. As is shown in FIG. 1 and FIG. 2, it is possible, in order to adjust the coupling, to design the distance between the two inner conductors, which do not belong either to the sole transmission path nor to the sole reception path, that is to say the distance between the inner conductors 42*a,* 42'*a* of the resonators which are strongly coupled to one another, to be shorter than the distance between the remaining inner conductors with respect to their signal path.

The strong coupling which has been explained, and which is also referred to as being supercritical, means that the two resonators R42 and R42' which, considered in their own right, each have a resonance point in the frequency range between the transmission band and the reception band and are tuned to this, oscillate at two so-called coupling resonant frequencies which are not the same as this and are not the same as one another, in the coupled state.

The separation (that is to say frequency difference) between these two coupling resonant frequencies is normally referred to as the coupling bandwidth.

In the case of resonators which are coupled to one another and are part of the same filter with the same filter path (transmission path or reception) in a duplex filter, this coupling bandwidth is generally somewhat narrower than the bandwidth of the filter or filter path. In other words, this coupling bandwidth is typically in the range between 50% and 100% of the bandwidth of the filter or of the filter path.

In the case of the strongly coupled interconnection resonator pair, this coupling bandwidth is in contrast wider than the respective bandwidth of the filter paths which are interconnected to from a duplex filter.

Figure 5:
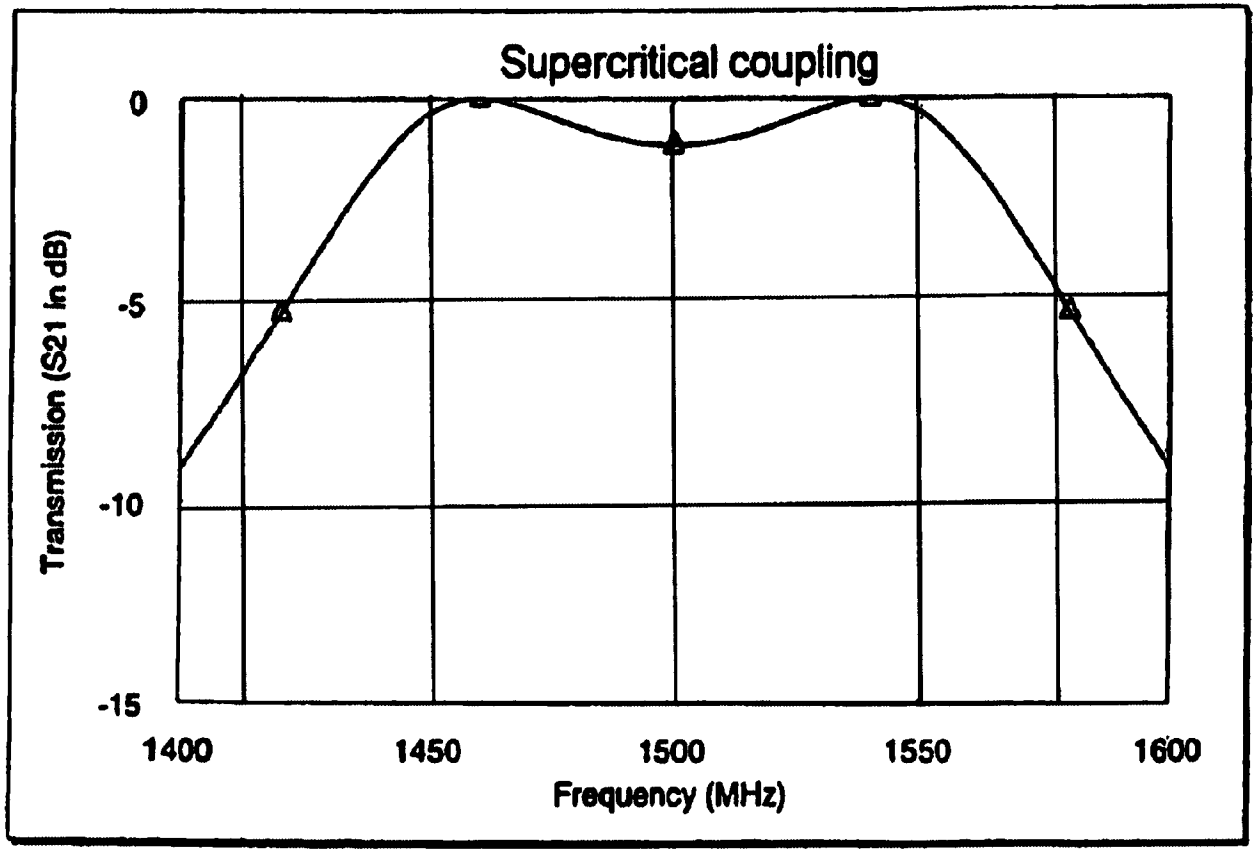
FIG. 5 shows an illustration of the resonance response of two supercritically coupled resonators.

The graph illustrated in FIG. 5 ill be used, by way of example, to show the transmission response of a circuit (that is to say of a filter) comprising two super critically coupled resonators. In this case, the frequency is plotted on the x-axis, and the scatter parameter S21 is plotted on the y-axis.

In this case, strong coupling is equivalent to a wide coupling bandwidth.

The frequencies of the resonators are tuned by using the tuning elements 9 which can be screwed in and out in the respective filter, as has already been explained with reference to FIG. 2, or as is described for an exemplary illustrative non-limiting implementation that differs from this in the prior publication EP 1 169 747. Further modifications of signal resonators which can be tuned are also possible.

The filter circuits of the transmission path, comprising the resonator chambers R41' and R41 are coupled through the further opening 48 between the second resonator chamber R41' of the interconnection resonator pair R42, R42' and their adjacent resonator chamber R41' to the second resonator R42', which is not used as the input as the input for the antenna A, in the interconnection resonator pair R42, R42'. The two resonator chambers R41' and R41 in the transmission path are likewise coupled to one another through an opening 48' in the single resonator wall. The transmission signals are input via the electrically conductive flat element 31' that is provided here.

A reception path is formed in a corresponding manner. In this case as well, a coupling connection is produced via an opening 49 from the second resonator R42' in the interconnection resonator pair to the resonator R43' and via a further opening 49' to the resonator R43, into whose resonator space the electrically conductive flat element 33' projects. The received signal which is received by the antenna A can be fed via this in the receiver R, that is to say it can be passed to the receiver R.

The resonators R41 and R41' are in this case tuned to frequencies in the transmission band, and the resonators R43, R43' are tuned to frequencies in the reception band.

The interconnection is balanced via a correspondingly balanced version of the coupling between the resonator chambers R42' and R41' on the one hand and the coupling between the resonator chambers R42' and R43' on the other hand. Significantly influencing variables are in this case the size, the position and the shape of the coupling openings in the resonator separating walls, and the distances between the axes of the respective inner conductors 42'*a* and 41'*a,* as well as 42'*a* and 43'*a*. All of these dimensions can be produced by milling, in a manner which can be reproduced mechanically to a satisfactory degree.

Figure 4:
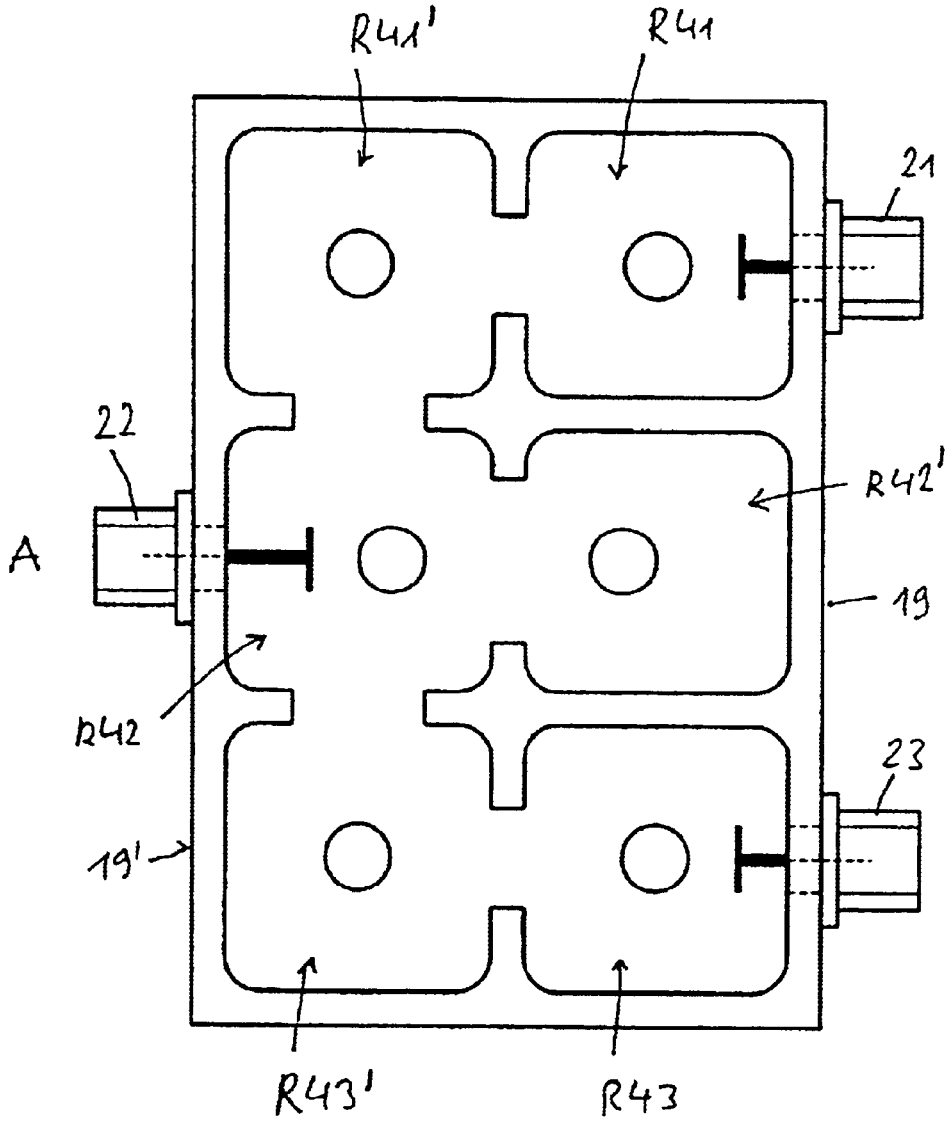
FIG. 4 shows an exemplary illustrative non-limiting implementation, modified from that shown in FIG. 1.

The following text refers to a modified exemplary non-limiting implementation as shown in FIG. 4.

This exemplary illustrative non-limiting implementation has a largely similar configuration. The difference from the exemplary implementation shown in FIG. 1 is that the central antenna connection, that is to say the central antenna socket 22, is provided on the opposite side 19' of the housing, in contrast to the two other coaxial connecting sockets 21, and 23. Thus, in this exemplary illustrative non-limiting implementations, shown in FIG. 4 for the filter circuits R41 and R41' in the transmission path to be coupled to the first resonator R42, which is used as the input to the connected common signal path A, of the interconnection resonator pair R42, R42'. In a corresponding manner, the receiver path with the resonator chambers R43 and R43' is likewise coupled to the first resonator chamber R42, which is used as the input.

Since, in the exemplary illustrative non-limiting implementation shown in FIG. 4, the connection 22 is provided opposite the two other connections 21 and 23, that is to say the first resonator chamber 42 which directly is connected to the antenna connection 22, and hence the associated resonator R42, are arranged on the opposite side 19' of the housing.

While the technology herein has been described in connection with exemplary illustrative non-limiting implementation, the invention is not to be limited by the disclosure. The invention is intended to be defined by the claims and to cover all corresponding and equivalent arrangements whether or not specifically disclosed herein.

What is claimed is:

1. Radio frequency diplexer having two or more resonators, said diplexer including:

at least three connections, providing a common signal path, a transmitting device and associated transmission path, and a receiving device and associated reception path, at least a first resonator associated solely with the transmission path, said first resonator associated solely with the transmission path being provided with an input for feeding in transmission signals, at least a second resonator associated solely with the reception path, said second resonator being provided with an output device to output the received signals at the associated connection, and at least third and fourth additional resonators, at least one of said third and fourth resonators being provided with an input/output for feeding signals from a common signal path and for outputting signals to the common signal path, the third and fourth additional resonators forming an interconnection resonator pair which are strongly coupled to one another, wherein both the transmission path and the reception path are coupled to at least one of the third and fourth resonators for inputting to/outputting from the common signal path.

2. The radio frequency diplexer according to claim 1, wherein:

said third and fourth resonators form an interconnection resonator pair which are strongly coupled to one another, wherein both the transmission path and the reception path are coupled to at least one of the third and fourth resonators provided for inputting to/outputting from the common signal path.

3. The radio frequency diplexer according to claim 1, wherein the third and fourth resonators have inner conductors each having an axis, the distance between the axis of the inner conductors of the interconnection resonator pair is less than the distance between the first and second resonators which are located alongside one another on the respective signal path.

4. The radio frequency diplexer according to claim 1, wherein the radio frequency diplexer has a total of 2n resonators, where "n" is an natural odd integer, with the resonators being arranged in two rows of n resonators each.

5. The radio frequency diplexer according to claim 1, further including a housing and three connecting sockets fitted on the same side of the housing, for connection of a common signal path, of a transmitter and of a receiver.

6. The radio frequency diplexer according to claim 1, wherein at least one resonator has a coaxial configuration.

7. The radio frequency diplexer according to claim 1, wherein at least one resonator comprises a dielectric.

8. The radio frequency diplexer according to claim 7, wherein at least one resonator comprises a ceramic.

9. An RF diplexer comprising:

a first resonator associated with a transmission signal path;

a second resonator associated with a receive signal path separate from said transmission signal path; and plural interconnection resonators associated with a further input/output signal path common to both the receive signal path and the transmission signal path, wherein said plurality interconnection resonators are strongly coupled to one another.

10. The diplexer of claim 9 wherein said plurality interconnection resonators comprise a strongly coupled resonator pair.

11. The diplexer of claim 9 wherein said plural interconnection resonators balance the interconnection between said common input/output signal path and said transmission and receive signal paths.

* * * * *